United States Patent [19]

Stromback

[11] Patent Number: 4,982,545

[45] Date of Patent: Jan. 8, 1991

[54] ECONOMICAL STEEL ROOF TRUSS

[76] Inventor: Gustav M. Stromback, 18700 Farm to Market Rd. 1431, Jonestown, Tex. 78675

[21] Appl. No.: 378,280

[22] Filed: Jul. 10, 1989

[51] Int. Cl.[5] ..... E04B 7/02; E04C 3/11

[52] U.S. Cl. ..... 52/639; 52/93

[58] Field of Search ..... 52/639, 641, 643, 691, 52/90, 92, 93, 690, 691, 692

[56] References Cited

U.S. PATENT DOCUMENTS

| | | | |
|---|---|---|---|
| 2,067,403 | 1/1937 | Lea | 52/92 |
| 2,234,960 | 3/1941 | Buelow | 52/92 |
| 2,642,825 | 6/1953 | McElhone et al. | 52/641 |
| 3,668,828 | 6/1972 | Nicholas et al. | 52/92 |
| 4,435,940 | 3/1984 | Davenport et al. | 52/639 |
| 4,551,957 | 11/1985 | Madray | 52/90 |
| 4,616,453 | 10/1986 | Sheppard, Jr. et al. | 52/93 |

FOREIGN PATENT DOCUMENTS

| | | | |
|---|---|---|---|
| 476296 | 8/1951 | Canada | 52/92 |

*Primary Examiner*—Michael Safavi

*Attorney, Agent, or Firm*—Joseph F. Long

[57] ABSTRACT

An economical steel roof truss for spanning large areas with unique shapes for maximum in use strength and splicing segments to use lengths that are easily handled and with a design to use minimum thickness metal consistent with loads and assembly costs.

2 Claims, 4 Drawing Sheets

ECONOMICAL STEEL ROOF TRUSS

BACKGROUND

In the United States there appears to be an ever increasing need to reduce the depletion of our forests by increasing the use of steel or structural plastics. This invention pertains to the design and manufacture of steel roof trusses on a most economical basis, taking into account total pounds of metal, assembly labor, and shipping costs.

With high speed computers it is now possible to design lowest cost trusses taking diverse factors into consideration for each job. This invention takes advantage of such computer capabilities.

Minimum metal usage will be achieved using minimum pounds of metal for shapes and reinforcing arrangements that give needed strength to meet the structural codes (which have, of course, necessary safety factors) but a most economical truss means most economical installed truss and as such, material handling, shipping, truss spacing to not only carry the usual live and dead loads but, in some cases, to give necessary between—truss space, must all be, taken into account along with assembly time and labor cost.

Roll forming of flat metal to form truss member shapes is an economical method of manufacture. Larger machines now allow rolling of U shaped members with more than 5" legs. In a preferred embodiment of the invention the top chord truss members are rolled in a flat bottomed U shape with one or more reinforcing ridges rolled into the base of the U that may be more than 1" wide and with one or more reinforcing ridges in each of the legs of the U that may be more than 5" in length and finally with a rolled out flange at the top of the legs—overall shape may be easily roll formed and gives near maximum strength for pounds of metal used. Since handling of very long lengths is difficult, the top chord and also bottom chord members are usually made approximately 20' long. Now spans of more than 70' are frequently required and shipment of a 70' truss with the usual 5 in 12 pitch becomes expensive because of size and difficulty of handling such a large unit. Thus, in many cases, job site assembly of individual trusses is preferred. Shipment of truss members up to 20' in length is quite economical. The invention encompasses specially rolled-to-fit splicing sections for both top and bottom chord members and special heel reinforcing sections for load bearing joints formed from segments of web members of the truss. These segments may be about 6" long and installed in vertical position in the load bearing joint formed where the bottom chord of the truss ties into the top chord near a terminal end of each truss unit.

The bottom chord members have a U shaped cross section with one or more reinforcing ridges rolled into the flat bottom of the U shape and with one or more reinforcing ribs in the legs of the U, which may be more than 3", and with the ends of the legs folded back to form a double thick edge.- With the shape as described the end of the lower chord member will slide into the end of the upper chord member to form a load bearing joint at each end of the lower chord member. As previously described a vertical segment of a C shape web member is used in the joint for further reinforcement.

With lower chord members usually manufactured in 20" lengths a second rolled to fit splicing section that may be more than 12" long is used to splice butted-together ends of chord members to form a chord unit.

Truss web members have a C shaped cross section with one or more reinforcing ribs in the side of the C shape and are sized to fit easily into and between the upper and lower chord units.

Power driven self tapping screws are used in one preferred embodiment for assembly. Bolts or rivets could also be used or a combination of different fastening methods could be used for assembly.

The computer design program checks for most economical design using 14, 16, 18, or 20 gauge metal and using heavier gauge metal members to reinforce a weaker point in the truss design. Final design also indicates the number and size of self tapping screws at each connecting point in the truss in a preferred embodiment.

We have considered the following patents in Class 52, subclasses 634, 639, 641, 643, 690, 692 and 693:

U.S. Pat. No. 1,311,486
U.S. Pat. No. 2,541,784
U.S. Pat. No. 3,656,270
U.S. Pat. No. 4,074,487
U.S. Pat. No. 4,435,940
U.S. Pat. No. 4,416,453
U.S. Pat. No. 4,720,956

In our opinion the subject invention is uniquely different to fill the need for the lowest cost truss for various structural requirements.

BRIEF DESCRIPTION OF THE INVENTION

Roof trusses, which are quite generally in an overall triangular shape, are made with maximum strength when designed to use the rigidity of a triangular structure between the top sloping members or top chord of the truss and the bottom horizontal member or bottom chord of the truss.

In this invention top chord members, bottom chord members, and web members, members used to form triangle type connection between bottom and ,top chord members, are designed to achieve the most economical installed roof truss taking into account weight of the metal, distance spanned, desired distance between trusses, shipping, job site assembly, live load, dead load, wind load, desired pitch, and assembly labor cost using power driven self tapping screws with a minimum number to give necessary joint strength.

The top chord members have a more or less top hat cross section with reinforcing ribs as shown in the drawings.

The bottom chord members are essentially U shaped with a folded back double edge on each leg of the U with reinforcing ribs in each leg of the U and in the bottom section of the U shape as shown in the drawings. Theoretical calculations indicate that these reinforcing ribs add more than 20% to compressive strength even though they may be only ⅛" high.

The web members have a C shape cross section with one or more reinforcing ribs in the side of the C and are designed to fit inside the upper and lower chord members.

Specially rolled-to-fit splicing sections that may be more than 12" long are used to splice both butted together upper chord members and lower chord members.

Assembly may be as follows:

1. Two upper chord units that each may be of two or more spliced together chord members are fastened together at an apex along with the top end of a single or doubled web member that is in a vertical position using self tapping screws. The web member then becomes a king post. A single larger web member may also be used for a king post.

2. The lower end of the king post is fastened to the center of the lower chord unit, which may be of two or more lower chord members spliced together.

3. The ends of the lower chord unit are fitted into the upper chord units and a short reinforcing web segment is fitted vertically into the end of the joint so formed and self tapping screws are power driven in each side of the joint to rigidly fasten together the top chord unit and bottom chord unit ends and reinforcing web segment to form a reinforced load bearing joint for each end of the truss. Commonly, extra strength studs are used under the loading bearing joints or ends of the truss.

4. Web members are fitted into the top and bottom chord units to form triangular reinforcing structures between the chord units and are fastened into the top and bottom chord units with self tapping screws.

Minor mechanical changes may readily be made in this design so that we do not wish to be limited to exact details but only to the general spirit and purpose as outlined in these claims and specifications.

DETAILED DESCRIPTION OF THE DRAWING

Figure 1:
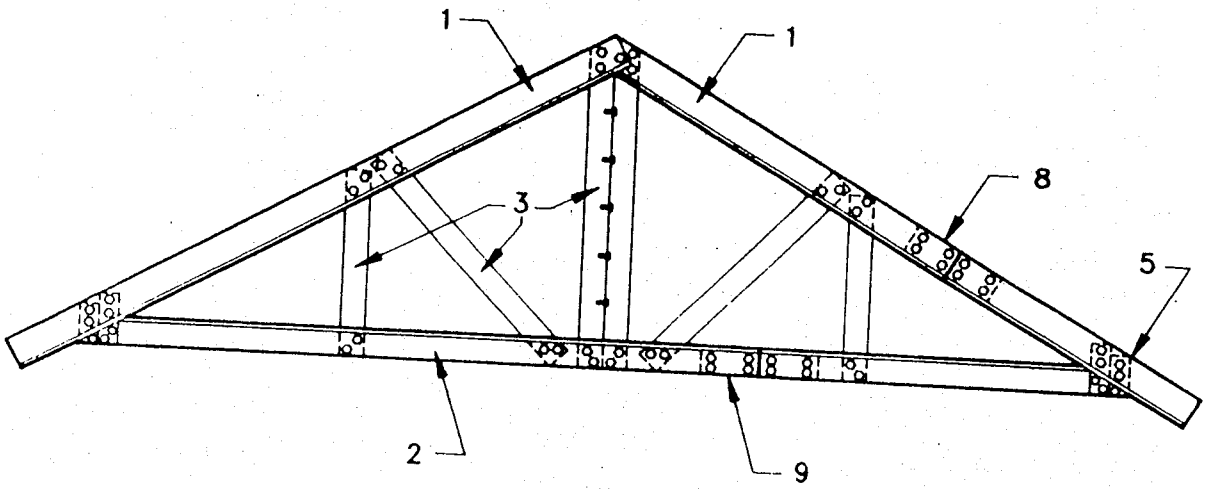
FIG. 1 shows an overall shape of the truss indicating spliced members and spliced lower chord members.

FIG. 1 shows a typical assembled truss showing an exterior splicing section 8, splicing two of the upper chord members and an exterior lower chord splicing section 9 in the lower chord unit 2. The U shape of the lower chord 2 is facing up while the U shape of upper chord 1 is facing downward so that web members 3 fit snugly into upper and lower chord units 1 and 2 respectively. Note double web members 3 fastened together with self tapping screws may be used as the king post with the vertical members 3 fastened into the apex of the truss and to the center point of the lower chord 2. Note that in other embodiments the apex of the truss may not be at the center and the king post, which could be a larger web member, would then drop vertically from the apex to fasten into the bottom chord 2 at a point below the truss apex but not at the center of the bottom chord 2. Load bearing joint 5 is shown in more detail in FIG. 9.

Figure 2:
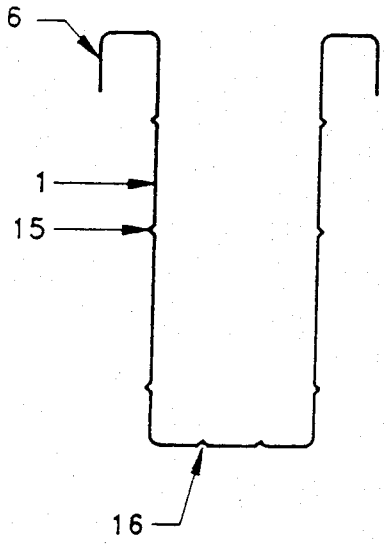
FIG. 2 shows cross section of upper chord members.

In FIG. 2 we show a cross section of upper chord 1 with two rolled out reinforcing flanges 6 and with three rolled in reinforcing ribs 15 that may be ⅛" high in each of the legs and with two rolled in reinforcing ribs 16 in the base of the chord 1.

Figure 3:
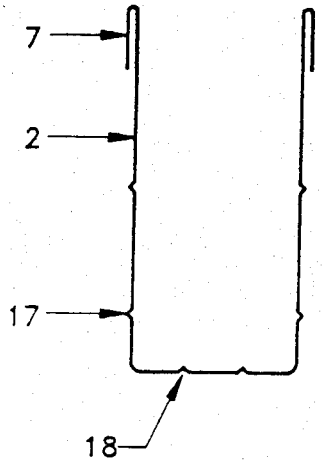
FIG. 3 shows cross section of lower chord members.

In FIG. 3 we show a cross section of lower chord 2 with the rolled flat reinforcing flange 7. This rolled flat flange allows the end of lower chord 2 to slide into upper chord 1 to form load bearing joint 5 which is shown in detail in FIG. 9. The rolled out reinforcing ribs 17 and the rolled in reinforcing ribs 18 may be only ⅛" in height and there will be sufficient flexibility in chords 1 and 2 to allows rigid fastening with self tapping screws.

Figure 4:
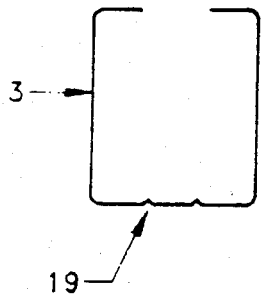
FIG. 4 shows cross section of web members.

In FIG. 4 we show a cross section of web member 3. Two rolled in reinforcing ribs 19 are shown in this member.

Figure 5:
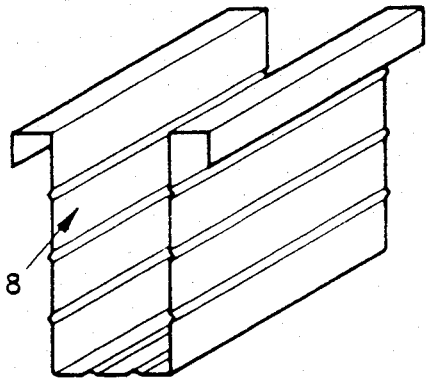
FIG. 5 shows rolled-to-fit section of upper chord members that is used splicing.

In FIG. 5 we show splicing section 8 that is shaped exactly like the upper chord 1 but is rolled-to-fit either over or into the upper chord 1 in order to allow splicing by butting two upper chord 1 members together and fastening the closely fitting splicing section 8 over the butted ends and fastening rigidly with a plurality of self tapping screws.

Figure 6:
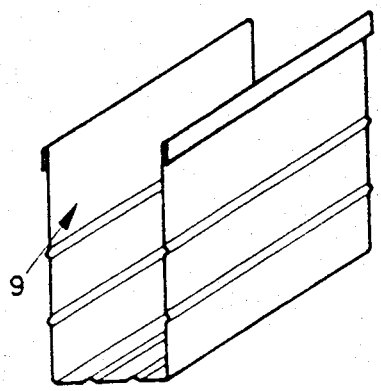
FIG. 6 shows rolled-to-fit section of lower chord member that is used splicing.

In FIG. 6 we show a splicing section 9 used to splice lower chord members 2 together in a similar manner as described for the upper chord members.

Figure 7:
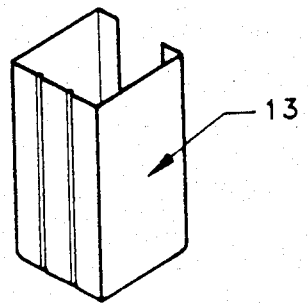
FIG. 7 shows a segment of a web member that is used for heel reinforcing load bearing end joints.
Figure 9:
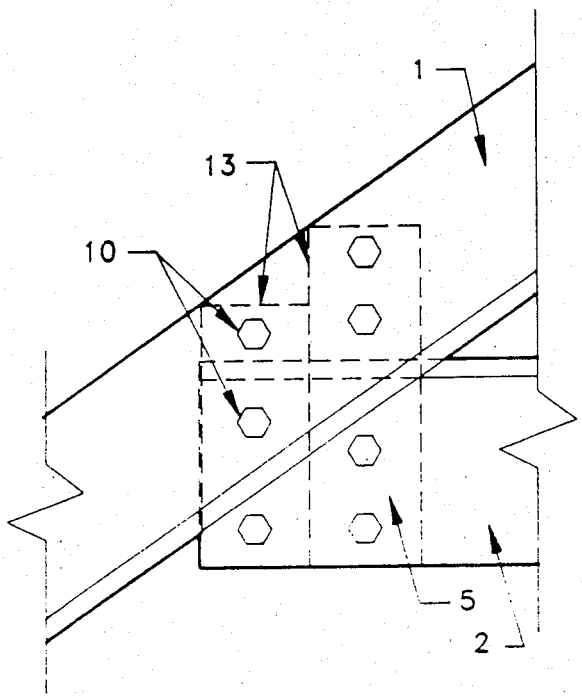
FIG. 9 shows detail of a load bearing end joint with vertical heel reinforcement in the joint.

In FIG. 7 we show a segment 13 of a web member 3 that may be approximately 5" long that is used inside of load bearing joint 5 as shown in detail in FIG. 9.

Figure 8:
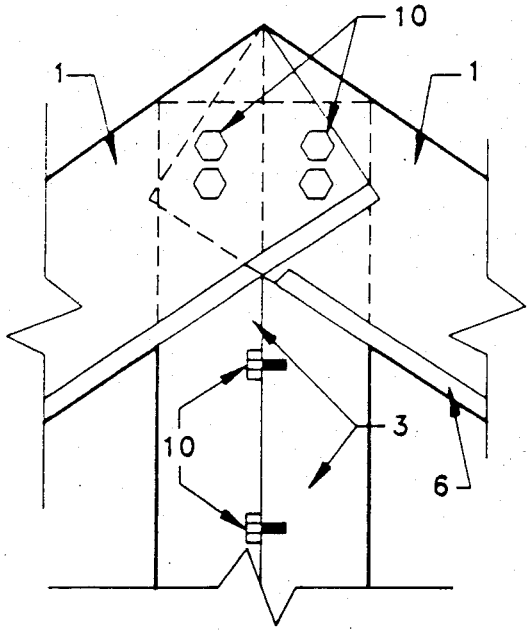
FIG. 8 shows detail of the apex of the truss with doubled web member a king post.

In FIG. 8 we show in detail the connection of chord members 1 and web members 3 at the apex of the truss. A portion of flange 6 of one end of chord 1 is removed and the other chord 1 end is deformed slightly outward to fit over the end with the flange portion removed and the ends of two web members 3 which may be fastened back to back with self tapping screws 10 to form a king post, slide into the apex. Self tapping screws 10 on each side of the apex go through the ends of two chord members 1 and 2 and through the ends of web members 3, that form the king post, giving a rigid connection at the truss apex.

In FIG. 9 we show details of load bearing joints 5 which are at each end of the truss. Heel reinforcing segments 13 slide inside the end of lower chord 2 in a vertical position and this end of lower chord 2 is then pushed into the slightly bulged out end of upper chord 1 and self tapping screws 10 are used to fasten chord member 1, chord member 2, and segments 13 together to form load bearing joint 5. A portion of the wall below the load bearing joint 5 may be reinforced with an extra or larger stud 20.

I claim:

1. An economical steel roof truss for spanning large areas comprising:

(1) two top chord units with a cross sectional top hat shape with rolled flanges on the outer edge on each leg of said cross sectional top hat shape and reinforcing ridges in said legs and base of said top hat shape and with the length of said legs of said top hat shape a minimum of twice the width of said base of said top hat shape; said top chord units being joined to each other at a first end, together with a top end of two C shaped web members to form an apex of a triangular shape with said two C shaped web members being fastened to each other back to back to form a king post;

(2) a lower chord unit connected with said top chord units and said king post and formed by splicing a minimum of two lower chord members with a cross sectional U shape with a portion of legs of said U shape rolled back to form a double thickness reinforcing edge and, with legs of said U shape being a minimum of twice as long as a base of said U shape and reinforcing ridges rolled in said legs and said base of said U shape;

(3) a rolled-to-fit lower chord member splicing means rigidly fastened with self tapping screws to butted-together first ends of lower chord members to form said lower chord unit; said lower chord unit being fastened at a central point to a bottom end of said two C shaped web members with said bottom end fastened within said legs of said U shaped cross section of said lower chord unit with self tapping screws.

(4) a heel reinforcing segment, cut from a section of one of said C shaped web members, fastened in a vertical position inside a load bearing end of said steel truss; said load bearing end being formed by fastening each end of said lower chord unit to a second end of said upper chord units with said heel reinforcing segment being in a vertical position inside said each end of said lower chord unit, (5) bracing members between said top chord units and said bottom chord units comprising said C shaped web members fastened at a top end inside said top chord unit and at a bottom end inside said bottom chord unit in a triangular pattern with self tapping metal screws to complete said steel roof truss for spanning large areas.

2. An economical steel roof truss for spanning large areas as in claim 1 wherein each of said top chord units may be formed by splicing similarly shaped top chord members using a rolled-to-fit splicing piece and fastening through said splicing piece and said top chord members to form a rigid splice using self tapping screws.

* * * * *